United States Patent [19]

Lorant

[11] 4,261,173

[45] Apr. 14, 1981

[54] HOT GAS ENGINE HEATER HEAD

[75] Inventor: Stefan Lorant, Oxie, Sweden

[73] Assignee: Kommanditbolaget United Stirling (Sweden) AB & Co., Malmo, Sweden

[21] Appl. No.: 6,770

[22] Filed: Jan. 26, 1979

[51] Int. Cl.[3] ..... F02G 1/04

[52] U.S. Cl. ..... 60/525

[58] Field of Search ..... 60/517, 525, 526

[56] References Cited

U.S. PATENT DOCUMENTS

| | | |
|---|---|---|
| 3,011,306 | 12/1961 | Meijer . |
| 3,817,036 | 6/1974 | Hakansson . |
| 3,940,934 | 3/1976 | Hakansson . |
| 4,069,670 | 1/1978 | Bratt et al. . |

*Primary Examiner*—Allen M. Ostrager
*Attorney, Agent, or Firm*—Finnegan, Henderson, Farabow, Garrett & Dunner

[57] ABSTRACT

A heater head for a multi-cylinder, double-acting hot gas engine in which each cylinder is surrounded by an annular regenerator unit, and in which the tops of each cylinder and its surrounding regenerator unit are interconnected by a number of heater tubes. To provide for a single heater head for a plurality of sets of tubes connecting cylinder tops and surrounding regenerator unit tops, arcuately shaped manifolds are provided on the tops to form two complete concentrically disposed circles.

8 Claims, 4 Drawing Figures

HOT GAS ENGINE HEATER HEAD

BACKGROUND OF THE INVENTION

1. Field of the Invention

The present invention relates to a heater head for a multi-cylinder, double-acting hot gas engine, such as a Stirling engine, in which each cylinder is surrounded by an annular regenerator unit, the tops of each cylinder and its surrounding regenerator unit being interconnected by a number of heater tubes.

2. Description of the Prior Art

In the past, the heater tubes of hot gas engines connecting a cylinder and its surrounding regenerator unit have been symmetrically arranged and evenly distributed relative to the axis of the cylinder. Therefore, it has been necessary to provide a separate combustion chamber for each cylinder.

It is generally accepted that for automotive use, as well as for other purposes where a high power output per unit of weight and volume is desirable, the double-acting type of hot gas engine is preferred. For that reason and for economic reasons it is desirable to use a single combustion chamber for a number of cylinders and regenerator units. To obtain a suitable heater head configuration for such a hot gas engine, it has been found necessary to design the regenerator units as elements separate from the cylinders, as shown, for example, in U.S. Pat. No. 2,817,950.

Designing the regenerator units as elements separate from the cylinders, however, increases the cost of the heater head.

SUMMARY OF THE INVENTION

In view of the high cost of conventionally designed heater heads, the object of the present invention is to provide a heater head for a multi-cylinder, double-acting hot gas engine having a plurality of regenerator units each individually surrounding a cylinder, the heater head being suitable for use in a single combustion chamber.

To achieve the object and in accordance with the purpose of the invention, as embodied and broadly described herein, the invention is directed to an improvement in a heater head for a multi-cylinder, double-acting hot gas engine in which each cylinder is surrounded by an annular regenerator unit, the tops of each cylinder and its surrounding regenerator unit being interconnected by a number of heater tubes, the improvement comprising a cylinder manifold forming part of each cylinder top, a regenerator manifold forming part of each regenerator top, the manifolds being arcuately shaped and forming two complete concentrically disposed circles, and heater tubes extending between the cylinder manifolds and the regenerator manifolds.

It is understood that both the foregoing general description and the following detailed description are exemplary and explanatory only and are not restrictive of the invention, as claimed.

The accompanying drawings, which are incorporated in and constitute a part of this specification, illustrate one embodiment of the invention and, together with the description, serve to explain the principles of the invention.

DESCRIPTION OF THE PREFERRED EMBODIMENTS

Reference will now be made in detail to the present preferred embodiments of the invention, the examples of which are illustrated in the accompanying drawings.

Figure 1:
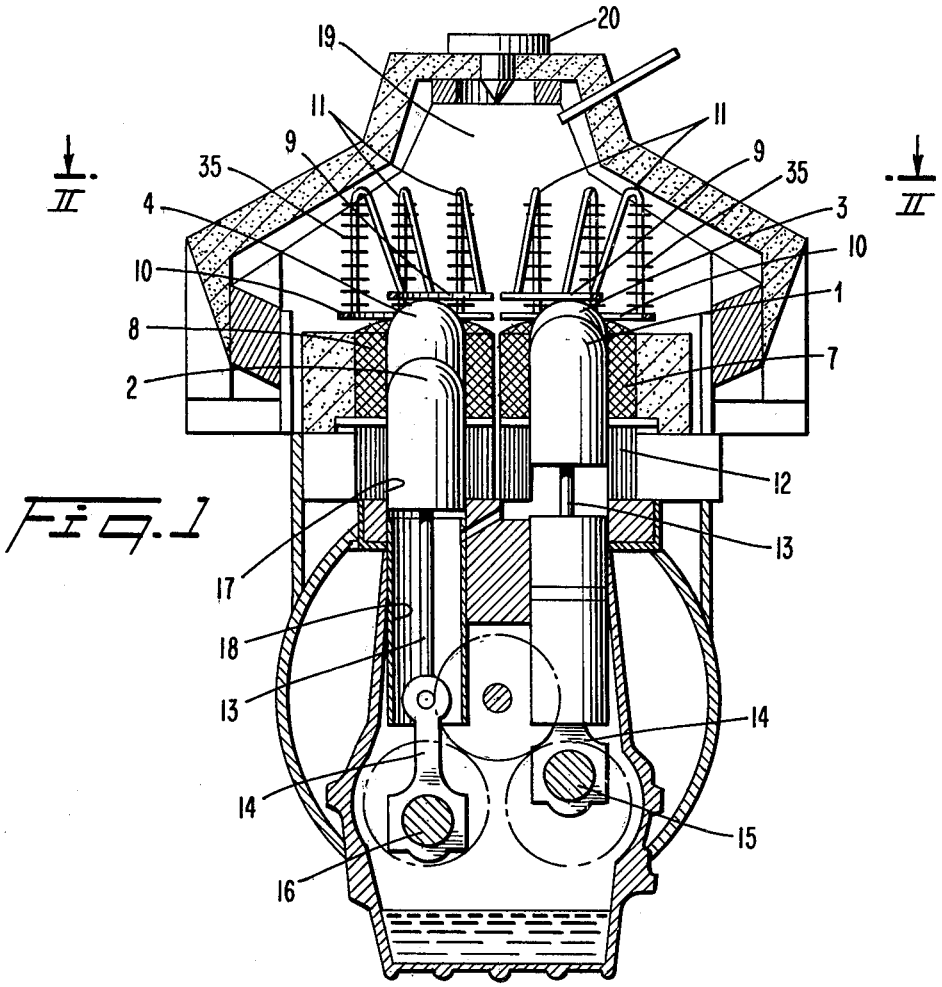
FIG. 1 is a vertical section through a hot gas engine provided with a heater head according to the present invention.
Figure 2:
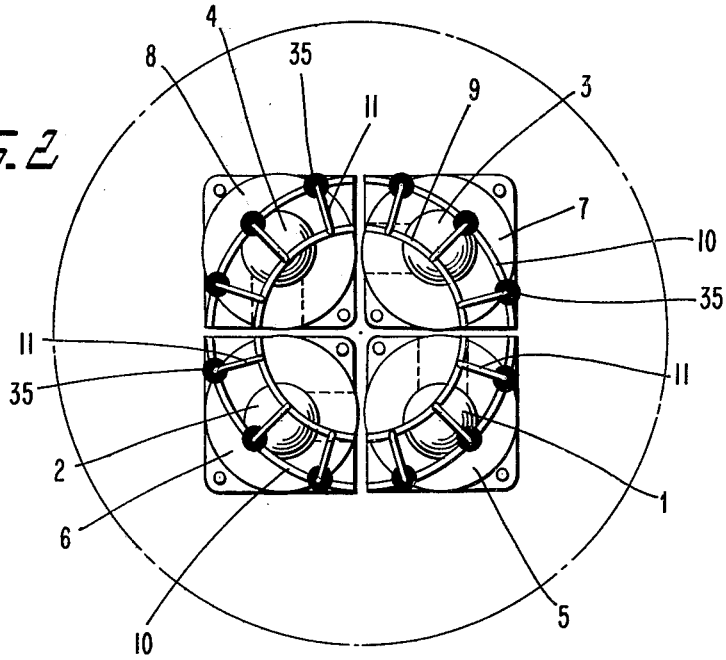
FIG. 2 is a horizontal section through the heater head of FIG. 1, the section being made along the line II—II of FIG. 1.

FIGS. 1 and 2 illustrate a multi-cylinder, double-acting hot gas engine having a heater head made according to the present invention. Generally, the engine includes a main body portion having bored therein four cylinders 1-4 in square formation. The four cylinders 1-4 are each surrounded by one of the annular regenerator units 5-8. The tops of the cylinders 1-4 are provided with individual arcuately shaped cylinder manifolds 9 which in their relative positions shown in FIG. 2 form a circle. The tops of the regenerator units are provided with individual regenerator manifolds 10 which form a circle of greater diameter than the circle formed by the cylinder manifolds 9.

The pairs of cylinder manifolds 9 and regenerator manifolds 10 thus formed are interconnected by tubes, which extend between the cylinder and regenerator manifolds. In one embodiment, as shown in FIG. 1, these tubes extend upwardly and radially outwardly from the cylinder manifolds 9 and are bent at their tops to extend vertically downwardly to the regenerator manifolds 10. A plurality of tubes 11 connect each pair of manifolds 9 and 10.

Each cylinder 1-4 of the double-acting hot gas engine shown in FIGS. 1 and 2 has a piston, shown generally as 12, mounted for reciprocating therein. Each piston 12 is provided with a piston rod 13 secured to a connection rod 14. The connection rods 14 are journaled to either crankshaft 15 or crankshaft 16 in a conventional manner.

The pistons 12 separate each cylinder into a high temperature working chamber 17, and a low temperature working chamber 18. The heater tubes 11 are traversing a combustion chamber 40. The engine also includes a preheater 19.

The vertically downwardly extending portions of tubes 11 are provided with surface enlarging fins 35 to increase their ability to absorb heat from the flow of combustion gases passing between the tubes 11 during their flow from combustion chamber 40 to preheater 19.

As shown in FIG. 2, the cylinder manifold 9, regenerator manifold 10 and connecting tubes 11 for each of the cylinders 1-4 and its respective regenerator form a separate unit. Each unit may be an integral unit formed of a single piece of material. The heater head in FIG. 2 is composed of four such identical separate units.

Figure 3:
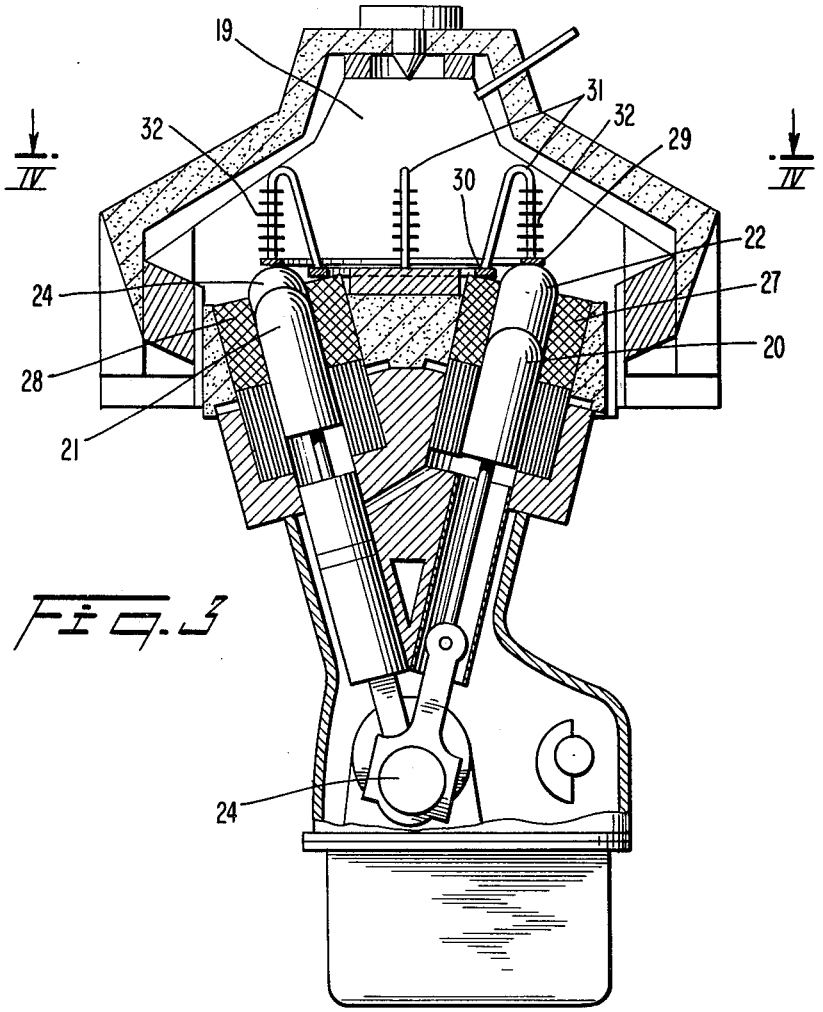
FIG. 3 is a vertical section through a V-engine having another type of heater head according to the present invention.
Figure 4:
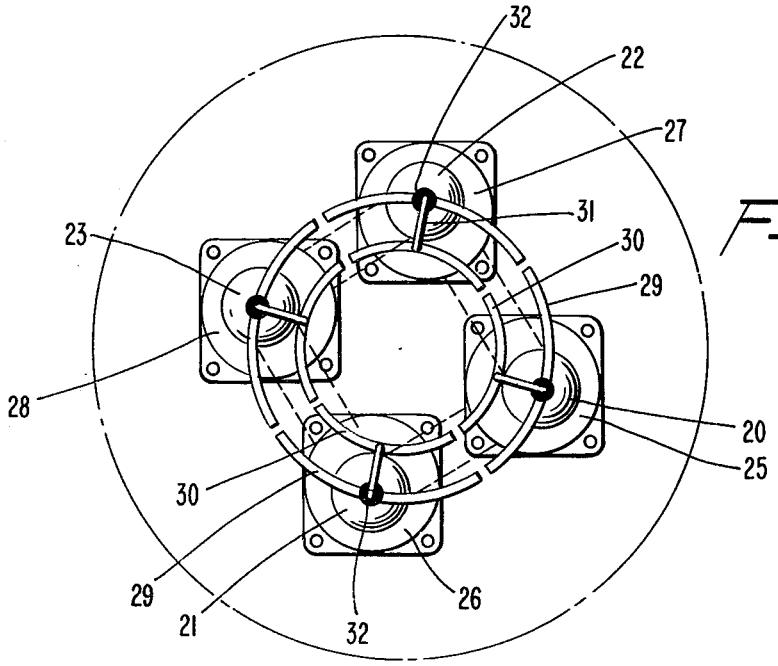
FIG. 4 is a section along the line IV—IV of FIG. 3.

The invention is also applicable to other engine configurations, e.g., the configuration shown in FIGS. 3 and 4.

The engine shown in FIGS. 3 and 4 is a double-acting hot gas engine having many of the elements previously identified in reference to FIGS. 1 and 2. The engine has four cylinders 20-23 arranged in a V formation and has a single crankshaft 24. Each cylinder is surrounded by one of regenerator units 25-28. The tops of cylinders 20-23 are provided with individual arcuately shaped cylinder manifolds 29 which, when in their relative positions shown in FIG. 4, form a circle. The tops of the regenerator units are provided with regenerator manifolds 30. The regenerator manifolds 30 form a circle of smaller diameter than the cylinder manifolds 29 in order to allow the heater head to fit into a combustion chamber 40 of suitable shape and size.

Tubes 31 interconnect cylinder manifolds 29 and regenerator manifolds 30. Tubes 31 extend upwardly and radially outwardly from regenerator manifolds 30 and are bent at their tops to extend vertically downwardly to cylinder manifolds 29. The vertically downwardly extending portions of the tubes 31 are provided with surface enlarging fins 32 to increase their ability to absorb heat.

As shown in FIG. 4, the cylinder top, regenerator top and connecting tubes 31 for each cylinder 20-23 and its respective regenerator form a separate unit. Each unit may be an integral unit formed of a single piece of material. The heater head of FIG. 4 is composed of two identical pairs of units.

Other embodiments of the invention will be apparent to the skilled in the art from consideration of the specification and practice of the invention disclosed herein. It is intended that the specification and examples be considered as exemplary only, with a true scope and spirit of the invention being indicated by the following claims.

What is claimed is:

1. In a heater head for a multi-cylinder, double-acting hot gas engine in which each cylinder is surrounded by an annular regenerator unit, the tops of each cylinder and its surrounding regenerator unit being interconnected by a number of heater tubes, the improvement comprising:

a cylinder manifold forming part of each said cylinder top, a regenerator manifold forming part of each said regenerator top, said manifolds being arcuately shaped and forming two complete concentrically disposed circles, and heater tubes extending between said cylinder manifolds and said regenerator manifolds.

2. The improvement of claim 1 wherein said heater tubes extend upwardly and radially outwardly from the cylinder manifold and are bent at their tops to extend vertically downwardly to the regenerator manifolds.

3. The improvement of claim 2 wherein surface enlarging fins are provided on said heater tubes.

4. The improvement of claim 1 wherein said cylinders are disposed in a V formation and the circle formed by said regenerator manifolds is smaller than the circle formed by said cylinder manifolds.

5. The improvement of claim 4 wherein said heater tubes extend upwardly and radially outwardly from the regenerator manifold and are bent at their tops to extend vertically downwardly to the cylinder manifold.

6. In a heater head for a multi-cylinder, double-acting hot gas engine in which each cylinder is surrounded by an annular regenerator unit, the tops of each cylinder and its surrounding regenerator unit being interconnected by a number of heater tubes, the improvement comprising:

a cylinder manifold forming part of each said cylinder top, a regenerator manifold forming part of each said regenerator top, said manifolds being arcuately shaped and forming two complete concentrically disposed circles, and heater tubes extending between said cylinder manifold and said regenerator manifold, said cylinder manifold, said regenerator manifold and said heater tubes forming a separate, integral unit for each cylinder.

7. The improvement of claim 6 wherein said heater tubes extend upwardly and radially outwardly from the cylinder manifold and are bent at their tops to extend vertically downwardly to the regenerator manifolds.

8. The improvement of claim 6 wherein said heater tubes extend upwardly and radially outwardly from the regenerator manifold and are bent at their tops to extend vertically downwardly to the cylinder manifold.

* * * * *